United States Patent [19]

Raab

[11] 4,043,163

[45] Aug. 23, 1977

[54] DEVICE FOR REMOVING THE PRESS REST FROM THE FRONT SIDE OF A DISC FOR EXTRUDING TUBES

[75] Inventor: Richard Raab, Rothenbach, Peg., Germany

[73] Assignee: DIEHL, Nuremberg, Germany

[21] Appl. No.: 655,941

[22] Filed: Feb. 6, 1976

[30] Foreign Application Priority Data

Feb. 7, 1975 Germany ..... 2505160

[51] Int. Cl.[2] ..... B21C 35/00

[52] U.S. Cl. ..... 72/255

[58] Field of Search ..... 72/254, 255; 29/239

[56] References Cited

U.S. PATENT DOCUMENTS

| | | | |
|---|---|---|---|
| 3,522,721 | 8/1970 | Whiting | 72/255 |
| 3,530,702 | 9/1970 | De Ridder | 72/255 |
| 3,688,543 | 9/1972 | Kamena | 72/255 |
| 3,805,575 | 4/1974 | Robra | 72/255 |
| 3,827,273 | 8/1974 | Kishino | 72/255 |

*Primary Examiner*—James L. Jones, Jr.
*Assistant Examiner*—J. C. Peters
*Attorney, Agent, or Firm*—Walter Becker

[57] ABSTRACT

A device for removing the press rest from the front side of a press disc for extruding tubes which has a substantially plane rear surface opposite the front side of the press disc. This disc comprises supporting means for supporting and holding the press disc from which is stripped a press rest. The device also comprises shearing means having a shearing surface which, when the press disc from which the press rest is to be stripped, rests on the supporting means, defines an obtuse angle with the rear surface of the disc. The disc and the shearing means are movable relative toward each other so as to cause the shearing means in response to such movement to strip the press rest off the press disc.

2 Claims, 6 Drawing Figures

DEVICE FOR REMOVING THE PRESS REST FROM THE FRONT SIDE OF A DISC FOR EXTRUDING TUBES

The present invention relates to a device for removing the press rest from the front side of a disc for extruding tubes. With discs for extruding tubes it is known to manually remove the so-called press rest of the metal block to be pressed. In this connection, however, the difficulty occurs that the press rest comprises an extension which extends into the axial bores of the press disc or extrusion disc which prevents a fast removal of the press rest.

It is, therefore, an object of the present invention to avoid the above mentioned cost causing working operation and to effect the removal of the press rest mechanically and in a minimum of time.

These and other objects and advantages of the invention will appear more clearly from the following specification in connection with the accompanying drawings, in which.

Figure 1:
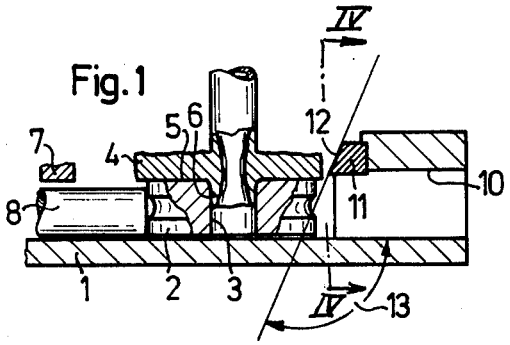
FIGS. 1–3 illustrate a shearing device according to the invention in different working positions.

The device for removing the press rest from the front side of a disc for use in connection with the extrusion of tubes is characterized primarily in that the press disc has that side thereof which faces away from the press rest resting on a plate or is so held that the press disc defines with a shearing surface an obtuse angle.

Referring now to the drawings in detail, a combined press disc 2 rests on a plate 1. The press disc 2 has a bore 3 for a non-illustrated pressing mandrel. A press rest 4 of a metal block pressed in a manner known per se adheres to an end face 5 of the press disc 2. The press rest 4 has an extension 6 which extends into the bore 3 of the press disc 2. The press disc 2 is engaged by a separating plunger 8 which is arranged in and guided by guiding means 7.

Figure 4:
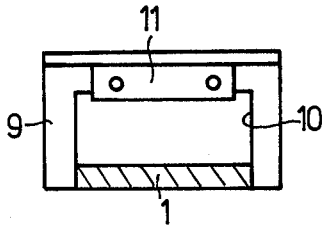
FIG. 4 represents a section taken along the line IV—IV of FIG. 1.

As will be seen in FIG. 4, plate 1 forms a component of a frame 9 which has an opening 10 for passing the press disc 2 therethrough. Connected to the upper edge of opening 10 on the frame side is a deflector strip 11, and the end face 12 of which defines with plate 1 an obtuse angle 13.

Figure 2:
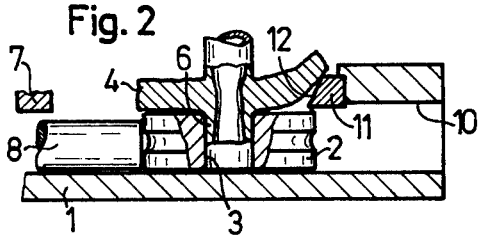
Figure 3:
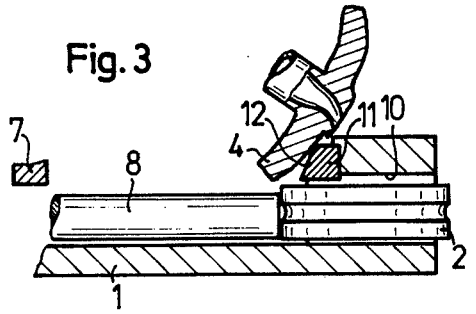

For purposes of shearing off the press rest 4, the plunger 8 presses the press disc 2 into the opening 10 (FIG. 2). As a result thereof, the deflector strip 11 lifts the press rest 4 including the extension 6 off the press disc 2 (FIG. 3).

Figure 5:
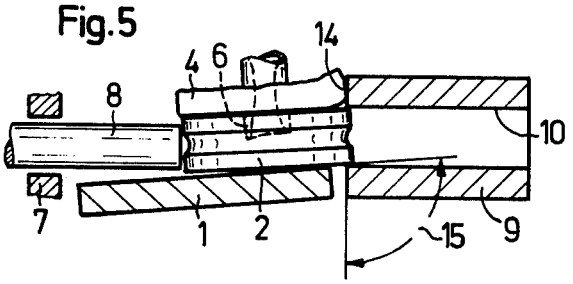
FIGS. 5 and 6 illustrate further shearing devices according to the invention.

According to FIG. 5, that end face 14 of frame 9 which is located at the side of the opening 10 defines with plate 1 an obtuse angle 15. The plunger 8 which is in alignment with the opening 10 and mounted in guiding means 7 presses the press disc 2 into the opening 10 whereby in a manner similar to that described in FIGS. 1–4, the press rest 4 together with the extension 6 is lifted off the press disc 2.

Figure 6:
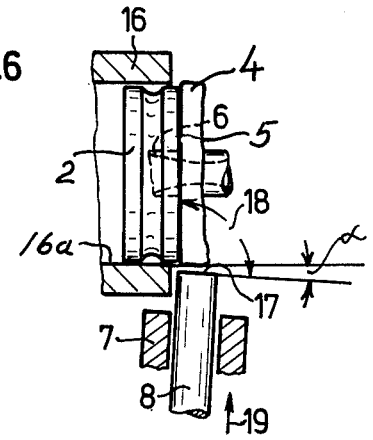

FIG. 6 illustrates a receiving body 16 for the press disc 2 which comprises the press rest 4 with the extension 6. FIG. 6 also shows the plunger 8 slidably mounted in guiding means 7. The end face 17 of the plunger 8 defines with the end face 5 of the press disc 2 an obtuse angle 18, and with the supporting surface 16*a* an acute angle $\alpha$.

The end face 17 of the plunger 8 moving in the direction of the arrow 19 lifts the press rest 4 in the above mentioned manner off the press disc 2. In this way, the press disc 2 is ready for operation for the next extrusion operation.

It is, of course, to be understood that the present invention is, by no means, limited to the specific showing in the drawings, but also comprises any modifications within the scope of the appended claims.

What I claim is:

1. A device for removing the press rest from the front side of a press disc for extruding tubes, which press disc also has a substantially plane rear surface opposite said front side, said device comprising in combination supporting means having a supporting surface for supporting the disc, also comprising separating means having a separating surface defining with said supporting surface an angle for lifing the press rest from the press disc, and a framework providing a passage for the disc, said separating surface being provided on said framework adjacent said passage.

2. A device in combination according to claim 1, in which the separating surface defines with said supporting surface an obtuse angle.

* * * * *